US005323724A

United States Patent [19]

Husain

[11] Patent Number: 5,323,724

[45] Date of Patent: Jun. 28, 1994

[54] CLOSED VAPOR CONTROL SYSTEM FOR THE ULLAGE SPACES OF AN OIL TANKER, INCLUDING DURING A CONTINUOUS MAINTENANCE OF AN ULLAGE SPACE UNDERPRESSURE

[76] Inventor: Mo Husain, 908 Stratford Ct., Del Mar, Calif. 92014

[21] Appl. No.: 845,210

[22] Filed: Mar. 2, 1992

Related U.S. Application Data

[63] Continuation-in-part of Ser. No. 377,886, Jul. 10, 1989, Pat. No. 5,156,109, and a continuation-in-part of Ser. No. 503,712, Apr. 3, 1990, Pat. No. 5,092,259.

[51] Int. Cl.[5] ..... B63B 25/12

[52] U.S. Cl. ..... 114/74 R; 114/72

[58] Field of Search ..... 114/72–74 R, 114/74 T, 74 A, 211, 212; 454/78, 79; 220/1 B, 5 A, 1 V, 85 S, 85 VR, 85 VS

[56] References Cited

U.S. PATENT DOCUMENTS

| | | | |
|---|---|---|---|
| 3,240,179 | 3/1966 | Van Ranst | 440/88 |
| 3,272,168 | 9/1966 | Donohue et al. | 114/74 R |
| 3,285,711 | 11/1966 | Stanford | 440/89 |

FOREIGN PATENT DOCUMENTS

| | | | |
|---|---|---|---|
| 2031905 | 1/1971 | Fed. Rep. of Germany | 114/74 R |
| 2335617 | 1/1974 | Fed. Rep. of Germany | 114/74 R |
| 0035082 | 3/1977 | Japan | 114/74 R |
| 0765108 | 9/1980 | U.S.S.R. | 114/74 R |

*Primary Examiner*—Edwin L. Swinehart
*Attorney, Agent, or Firm*—William C. Fuess

[57] ABSTRACT

Vapors, typically volatile organic compounds, emitted from a vaporizable liquid, typically oil, that is within a tank, typically a ship's tank, are (i) compressed, and (ii) stored in a reservoir that is closed to the atmosphere. The (i) compression typically transpires in and by a series/parallel array of pumps, rotary or reciprocating compressors, to a storage pressure of 150+ PSIA. The several million cubic feet ullage volume of a typical 200,000 ton oil tanker is typically compressed over a few days during and/or after loading, and stored in a typically spherical gas storage tank of some 10–20 feet in diameter. Stored gases are returned to the ullage spaces during offloading of the oil tanks in a closed system. This emission control by vapor recovery is interoperative with related systems and methods (i) to avoid spillage of oil due to the rupture of a ship's tank, and/or (ii) to make and maintain a mixture of gases and vapors within the tank's ullage space to be non-explosive and non-flammable. The first parallel system creates and dynamically maintains a partial vacuum in the tank's ullage space—even as all gases and vapors that are evacuated in order to do so are processed into the emission control system. The second parallel system injects an inert gas into the ullage spaces above the oil in the tanks—even though some of this inert gas becomes part of the compressed and stored gas and vapor mixture, rendering this compressed mixture itself non-explosive and non-flammable.

24 Claims, 2 Drawing Sheets

CLOSED VAPOR CONTROL SYSTEM FOR THE ULLAGE SPACES OF AN OIL TANKER, INCLUDING DURING A CONTINUOUS MAINTENANCE OF AN ULLAGE SPACE UNDERPRESSURE

REFERENCE TO RELATED PATENT APPLICATIONS

The present patent application is a continuation-in-part of U.S. patent application Ser. No. 377,886 filed Jul. 10, 1989 for a SYSTEM TO REDUCE SPILLAGE OF OIL DUE TO RUPTURE OF A SHIP'S TANK, issued Oct. 20, 1992, as U.S. Pat. No. 5,156,109 and also of U.S. patent application Ser. No. 503,712 filed Apr. 3, 1990, for INERT GAS CONTROL IN A SYSTEM TO REDUCE SPILLAGE OF OIL DUE TO RUPTURE OF A SHIP'S TANK, issued Mar. 3, 1992, as U.S. Pat. No. 5,092,259 which predecessor applications are to the same inventor as the present application.

BACKGROUND OF THE INVENTION

1. Field of the Invention

The present invention generally concerns systems and methods for controlling the emissions of vapors (particularly volatile organic compounds, or VOC) from a tank (particularly a ship's tank including the tanks of oil tankers) that contains vaporizable liquid(s) (particularly liquid hydrocarbons including oil) during any and all phases of the loading, unloading, or inerting (and, in the case of vessels, transport) of the tank and its ullage space whether the tank is filled, partially filled, or previously filled with the vaporizable liquid.

The present invention particularly concerns systems and methods closed to the atmosphere for the continuous control, and substantial avoidance, of all emissions of VOC from the oil tank(s) of a ship to the atmosphere during all phases of ship operation—including even as, and while, (i) the ullage spaces of the tank(s) are maintained, or dynamically maintained, at less than atmospheric pressures (for the purpose of spill avoidance through incipient ruptures), and/or (ii) the gases and VOC within the ullage spaces of the tank(s) are maintained non-explosive and non-flammable by being virtue of being enhanced in proportion of inert gas (for the. purposes of fire and explosion avoidance).

2. Background of the Invention

Men have filled and drained tanks with oil since before the age of petroleum. The gases, normally atmospheric gases, that are within the ullage spaces of oil-containing tanks are typically vented to the atmosphere when the tanks are filled, and replaced from the atmosphere (at least predominantly) when the tanks are emptied. The atmospheric gases that cycle in and out of the tanks come into typically prolonged contact with the oil that is within the tanks, or the remnants of the oil that are upon the walls of the tanks. The gases become saturated with volatile organic compounds (VOC), or oil vapors, to a level that is typically more dependent on (i) the ambient temperature, and (ii) the volatility of a particular oil or crude oil, than (iii) the time of exposure.

A large crude carrier, or oil tanker, may have a gas volume to the ullage spaces of its empty oil tanks that totals several millions of cubic feet. When gases saturated with VOC are released to the atmosphere from these ullage spaces they present a significant volume, and burden, of air pollution. New (circa 1991) U.S.

Governmental regulations hereinafter discussed mandate the control of these VOC emissions, and the abatement of air pollution arising from the oil tanks of ships (particularly including, but not limited to, oil tankers).

Meanwhile, any emission control system or method dealing with VOC emissions from the oil tanks of (particularly) ships cannot operate in isolation upon the oil contents and/or ullage space gases and VOC of such ships' tanks, but must successfully integrate with all other systems and methods also operating, in parallel, upon the liquid, gaseous, and vapor contents of the tanks. This 30 means that VOC emission control must be compatible with all normal loading and offloading of the oil contents of the tanks. Somewhat more subtlety, any emission control must be compatible with systems and methods for controlling the explosiveness and flammability of the gas-vapor mixture that is within the tanks' ullage spaces. Finally, and most subtlety, any emission control would desirably be compatible with any system or method of spill avoidance, that is being employed, or simultaneously employed, on the oil contents of the tanks. This means that if a particular ship has a double hull, or, alternatively, mid-decks isolating upper and lower tank volumes, for the purpose of oil spill avoidance, then its emission control system must operate compatibly with these features of the ship.

The emission control system and method of the present invention will be seen to be particularly compatible, and interoperative, with (i) a particular, relatively new, system for the avoidance of oil spills from a ship's tank(s), and (ii) a particular, also relatively new, system for controlling the explosiveness and flammability of the gas-vapor mixture that is within the ullage space(s) of the ship's tank(s). These two systems are discussed in the next two sections, after which sections the particular new requirements for emission control are summarized.

RELATED BACKGROUND TO THE PRESENT INVENTION—OIL SPILLAGE AVOIDANCE

Avoidance of spillage from the rupture of tanks containing liquids—typically oil—is desirable on economic, environmental, and aesthetic grounds. With the advent of supertankers, a single incidence of an oil spill from a large tanker can (i) cause significant damage to the environment, (i) disrupt the ecological balance, and (i) cause substantial economic loss. The accident of EXXON VALDEZ is perhaps the worst oil spillage disaster in U.S. history. The EXXON VALDEZ leaked about 240,000 barrels—over 10 million gallons of oil The economic and environmental cost is estimated to have been over two billion dollars.

The predecessor, related, patent applications to the present application teach inventions for reducing or foresteming any outflow of liquid, such as oil, due to the rupture of a tank, typically a ship's tank. The system, and method, of one related invention involves the creation, and the subsequent dynamic maintenance, of a partial vacuum in the effected tank or tanks. A partial vacuum below atmospheric pressure is preferably, and initially, created in the ship's tank before any rupture has occurred, and normally after a filling of the tank and before disembarkation of the ship. Thereafter the partial vacuum is continuously dynamically maintained in a precise balance responsive to the forces acting on the liquid contents of the tank, which forces change when the tank is ruptured. The dynamically maintained partial vacuum serves to hold the liquid contents of the tank within the tank even if, and when the tank is ruptured—much in the manner that liquid is held within an inverted glass when the glass is pulled above the liquid level of a reservoir.

If the rupture is below the water line, and on the side of the ship's hull, then surface tension dynamics at the rupture between the tank's interior liquid, nominally oil, and the exterior water will induce a stratified flow, forcing water into the tank through the lower part of the rupture while forcing the liquid oil upward and out of the tank, oppositely .to the flow of water. This stratified flow will continue until the water level reaches the top part of the rupture.

In one, preferred, embodiment of a related invention this stratified flow is stopped because a non-structural barrier, typically a tarpaulin, is placed over the rupture. The barrier is placed over the rupture even as, and while, the partial vacuum is dynamically maintained. The combination of dynamic underpressure control and the non-structural barrier substantially forestalls oil o outflow—even below the level of the rupture.

RELATED BACKGROUND TO THE PRESENT INVENTION—OIL TANK ULLAGE SPACE EXPLOSION AND FIRE AVOIDANCE

Another predecessor, related, patent application to the present application teaches the maintenance of an inert gas mixture in the ullage spaces above a combustible and vaporizable liquid, nominally oil, in a ship's tank for the purpose of preventing any explosion or combustion in the ullage spaces. The gas mixture is maintained sufficiently inert so as to prevent combustion even while, and during, the constant, and dynamic, simultaneous maintenance of an underpressure within the tank.

Accordingly, the related applications teach how to substantially contain a liquid, nominally oil, in a ruptured tank —at least temporarily.

NEW REGULATIONS LIMIT THE PERMISSIBLE EMISSIONS OF VOLATILE ORGANIC COMPOUNDS (VOC) FROM THE TANKS OF SHIPS

New requirements the limiting the permissible emissions of volatile organic compounds from the tanks of ships, primarily the oil tanks of oil tankers, while such ships are within U.S. territorial waters appear in the Clean Air Act of 1991.

The purpose of these requirements is to reduce air pollution in the port cities at which the ships transfer, and primarily unload, their liquid cargoes, primarily oil.

SUMMARY OF THE INVENTION

The present invention contemplates a control of any emissions of volatile organic compounds (VOC) and/or other vapors from the tanks of ships—particularly the tanks of oil tankers carrying oil in bulk—in a manner that is (i) completely closed to the atmosphere, ( ii ) quite reasonable, and therefore cost effective, in the amounts and sizes of equipments (primarily gas compressors and gas tanks) required, and (iii) highly automated, and therefore functionally reliable and cost effective, in operation. Moreover, the contemplated emission control system and method both compatibly, and (even more importantly) interoperatively, operates on the same ship's tanks as does (i) an underpressure, and preferably a dynamic underpressure, control system (in order to avoid the spillage of the contents of such tanks upon the occasion of a rupture), and, independently, (ii) still another, inerting, system for maintaining an inert atmosphere within the tanks' ullage spaces (in order to avoid risk of fire or explosion). The present invention—although independently implemented and exercised—is thus part of a comprehensive system of gas and vapor control in the (typically) oil tanks of (typically) ships.

In its most elementary embodiment, the vapor control system and method of the present invention includes (i) a connection to the gas discharge duct(s) of previously-configured tank ullage space underpressure, or dynamic underpressure, control system; (ii) a pump or pumps for compressing the gases and vapors (primarily VOC) collected at the discharge duct(s); and (iii) a compressed gas storage tank or tanks for storing at much reduced volume all those gases and vapors (VOC) that were previously vented to the atmosphere from the ullage space of the tank.

In one of its preferred embodiments particularly for the control of emissions from a tank of a ship, a system in accordance with the present invention includes (i) a ducted connection to an ullage space of the ship's tank, (ii) a pump for compressing gases and vapors collected from the ullage space through the ducted connection, and (iii) a storage tank for storing the compressed gases and vapors.

The pump is preferably implemented as several, typically two or three, parallel pump banks each of which contains a plurality, typically two or three, individual gas pumps, preferably gas pumps of the radial flow type, that are connected in series. The collective gas pumps thus typically form a 2×3, 2×3, 3×2, or 3×3 grid array. The series connection of the individual pumps is for successively compressing the gases from the ullage space at higher and higher pressures until a last such gas pump in each series connects to the storage tank. The parallel pump banks are to obtain such capacity as typically permits many millions of cubic feet of ullage space gases and vapors to be compressed in some tens of hours.

A heat exchanger, normally a counterflow heat exchanger exchanging the heat of the compressed gases with seawater, is preferably located between the pump means and the storage means. The heat exchanger removes some of a heat of compression from the compressed gases.

In its more comprehensive embodiments the system in accordance with the present invention for controlling any emission of vapors from any tank containing any vaporizable liquid is operative simultaneously with, and fully compatibly with, a tank ullage space underpressure control system for reducing or preventing any spillage of liquid due to an incipient rupture of the tank.

In such a combined system means a pressure less than atmospheric pressure is maintained within an ullage space of the tank containing the vaporizable liquid so that internal and external pressure forces acting on the liquid contents of the tank at a site of an incipient rupture to such tank will be in balance regardless that such forces should vary upon the occurrence, and upon the location, of the rupture. This underpressure maintenance is realized by an evacuation gas pump that is connected to the ullage space of the tank. The evacuation pump removes volumes of gases and vapors from the ullage space so as to maintain the pressure less than atmospheric therein. The evacuation pump is typically small, and typically performs no, or insignificant, compression of those gas and vapors that it extracts from the ullage space of the tank.

Meanwhile, the vapors of the vaporizable liquid that are within the removed gases are prevented from being vented to the atmosphere. This prevention of vapor-venting is realized by (i) a compression gas pump that compresses the gases, including the vapors, that are removed from the tank's ullage space by the evacuation gas pump, and by (ii) a storage tank that stores the compressed gases, including vapors, in isolation from the atmosphere.

Usefully, and in accordance with still another aspect of the present invention, the combined vapor-emission-controlling and liquid-spill-preventing system is itself still further combined with a system for rendering a mixture of gases and vapors within the ullage space of the tank to be non-flammable and non-explosive. The expanded system includes an inert gas pump, again connected to the ullage space of the tank, that is, this time, for pumping an inert gas into—as opposed to pumping gases and/or vapors from—the ullage space so as to maintain the non-flammable and non-explosive mixture of gases therein. Because of this inert gas inflow to the ullage space one of the gases that the evacuation gas pump is removing from the ullage space is the inert gas, and one of the gases that the compression gas pump is compressing is the inert gas. The slight loss in pumping and storage efficiency attendant upon extracting, and compressing, a gas that is added to the ullage space mixture of gases and vapors is more than compensated for by the advantage that the extracted and compressed gases and vapors, wheresoever transferred and stored, are themselves non-flammable and non-explosive—just as is the mixture of gases and vapors within the ullage space.

The systems of the present and related inventions fit together in an integrated, synergistic, manner for the complete control of liquids and gases, particularly oil and VOC's, during transport and storage, particularly by ship. The control encompasses (i) prevention of liquid spillage from tanks upon the incipient occurrence of ruptures to the tanks, (ii) avoidance of flammable or explosive conditions within the ullage spaces of tanks, and (iii) prevention of vapor emissions from the liquids within the tanks. The combined systems are particularly (but not exclusively) characterized by being very proactive, active, dynamic, and intelligent in their response to the normal, and abnormal, conditions of liquid transport and storage. The systems are generally computer-controlled, and automated. They represent an extremely cost-effective approach to foresteming the environmental damage and economic lost which has, in the past, all too commonly attended worldwide commerce in oil.

DESCRIPTION OF THE PREFERRED EMBODIMENT

Figure 1:
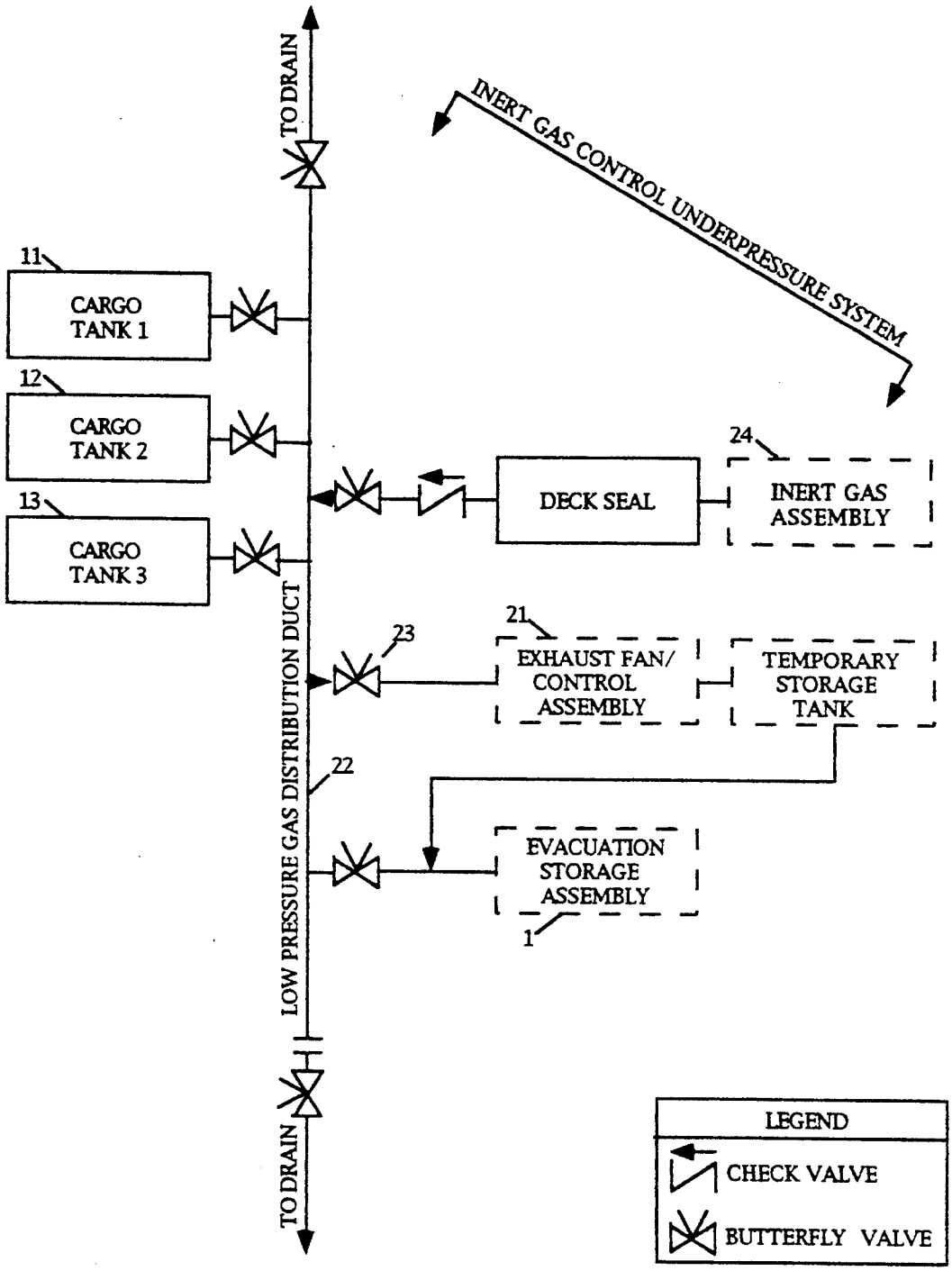
FIG. 1 is the overall schematic diagram of a complete vapor control system showing its functions of inerting, underpressure control, evacuation and storage for hydrocarbon vapor.
Figure 2:
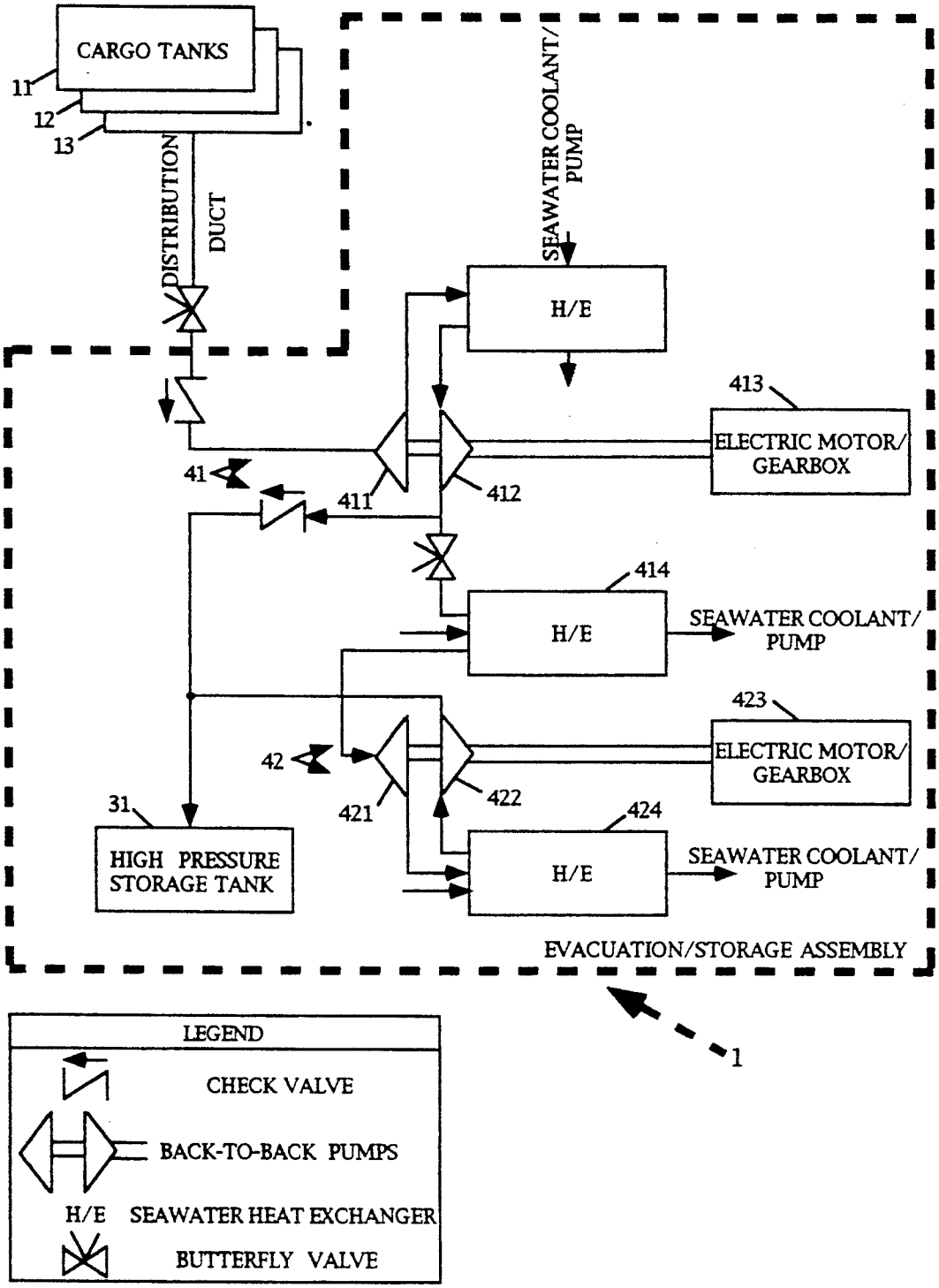

FIG. 2 is a detail schematic of the portion of the vapor control system, previously seen in FIG. 1, particularly for evacuation and storage of Volatile Organic Compounds from the ullage spaces of a ship's tanks 3.

A related invention to the present invention is taught in U.S. patent application Ser. No. 377,886 filed Jul. 10, 1989 for a SYSTEM TO REDUCE SPILLAGE OF OIL DUE TO RUPTURE OF A SHIP'S TANK, the contents of which application are incorporated herein by reference. A related invention is also taught in U.S. Pat. application Ser. No. 503,712 filed Apr. 3, 1990, for INERT GAS CONTROL IN A SYSTEM TO REDUCE SPILLAGE OF OIL DUE TO RUPTURE OF A SHIP'S TANK, the contents of which application is also incorporated herein by reference.

The systems of the related applications teach, jointly, the establishment and maintenance of an underpressure of a gaseous mixture enriched in inert gas within the ullage spaces of a ship's tanks during the voyage of the ship. This underpressure is dynamically maintained during the incipient and undesired occurrence of a rupture to the tank(s), and also during more mundane occurrences such as to compensate for the tank's leakage. Other major functions of the ship and its tanks—such as loading/unloading, gas freeing, and the inerting of empty tanks—are also realized by the related systems.

The emission control system of the present invention is specifically (i) compatible, and, better yet, (ii) interoperative with the related systems and all their functions. However, the emission control system of the present invention can also be used independently.

The preferred embodiment system of the present invention is specifically designed for controlling the emission of volatile organic compounds (VOC) from the oil tanks of ships, and particularly tankers, while such oil tanks are managed so as to have an underpressure in their ullage spaces. The preferred embodiment system of the present invention realizes VOC emission control during loading and unloading.

FIG. 1 shows the suggested configuration of the system. The table shows only one possible implementation of the system, which can be implemented in many variants. FIG. 2 is a detail schematic of the portion of the vapor control system, previously seen in FIG. 1, particularly for evacuation and storage of Volatile Organic Compounds from the ullage spaces of a ship's tanks.

There is a reference to detonation wave propagation in the background information delineated in the Federal Register/DOT/Coast Guard/33 CFR Parts 154, 155 and 156. The system of the present invention is a closed system with inerted VOC and the requirement for blast protection is therefore not envisioned. However, if regulations require installation of 'blast-valves,' it is suggested that blast valves similar to those used in protecting the missile systems 'housing' be adopted. This system has been in existence for a number of years in the aerospace industry. The system works on the principle of detecting the oncoming blast and then closing the valve for blast protection; since sensor information can travel approximately at the speed of light and blast waves travel at the speed of sound, there is adequate time to detect the oncoming blast and close the valve.

The vapor control system 1 functions when all tanks 11–13 require pressure-level adjustments simultaneously or when large pressure boostings are required. Ordinarily, minor adjustments to the pressure of tanks 11–13 are done by the existing blower system 2 of the ship's dynamic underpressure control system (reference the predecessor patent applications via the low pressure gas distribution duct 21 and valve 22. The vapor control system 1 captures the discharge gases from the ullage spaces of the tanker (during draw-down to establish the required underpressure) and compresses it to a higher pressure level so that it can be stored in a pressure vessel 31 of acceptable dimensions. This is done by some number of preferably identical compressor modules 41, 42 that can be ducted together to give the required range of compression. Each module 41, 42 is a self-contained unit consisting of an identical radial compressor 411, 412 and 421, 422 driven by a geared electric motor 413, 423 with the compressors discharges passing through sea-water heat exchangers 414, 424 so that the heat of compression is removed before it enters the next module.

The staging of the modules can be scheduled to provide the following desired storage container pressures as are later discussed.

With this flexibility the constraints of tanker structure, vapor pressure limitations, and the available storage container capacity can be met. From the following example, the capacity of storage container 31 can be 1/195 of the total ullage volume in the various tanks 11–13 with the stored temperature of the gaseous mixture can remain unchanged from its original value.

These modules 41, 42 can also be adapted functioning by similarly attaching them to the discharge vent ducts 22. For instance, previously during loading of the tanks 11–13, the tanks were initially inerted and as the tank is filled the ullage gas is presently allowed to escape to the atmosphere so that the ullage pressure was kept near ambient, atmospheric, pressure. With the vapor containment system of the present invention, the gaseous discharge from tanks 11–13 can be compressed to near 580 PSIA with, permitting an attendant reduction in storage tank volume and acceptable housing of the storage tanks on board the tanker. During the process of inerting the gases within the ullage spaces of the tanks 11–13, freeing gases from the ullage spaces of the tanks 11–13, pr purging the ullage spaces of the tanks, the vented gas can be similarly captured and compressed into reasonable volumes.

The design considerations of a system in accordance with the present invention include the following.

First, the heat of compression associated with compressing the gaseous mixture and its potential concerns in spite of the inert composition of the gaseous mixture.

Second, the pressure levels that can be sustained in the tank vessels due to the buckling loads on the tank structure when evacuating.

Third, the limits that vapor pressure of the oil sets on the pressure levels that exist in the tanks.

Solutions to these concerns are as follows.

The heat of compression is sizable but it can easily be handled by compressing the gas in stages and intercooling with seawater so that the compression temperature rise is removed prior to the next compression stage.

The next concern is the structural integrity of the tanker vessels when subjected to a decompression during the evacuation of the gaseous mixture. This limitation sets the range of compression required. For instance, if the tanker vessels can only sustain an underpressure of, say, 5 PSIA and the stored pressure is at 150 PSIA the maximum compression of the gases are 150/5=30. This structural limit is compatible with the typical vapor pressure of the tanker oils.

So, it is preferably to have some flexibility in the range of compression desired to meet the constraints of structural/vapor pressure requirements.

For example, a design might address a total tank volume $=7.2 \times 10^6$ FT$^3$ and an ullage volume (2%) $144 \times 10^3$ FT$^3$. In this sample tanker a tank is unloaded while it is filled with inert gas/HC mixture. Calculations give:

| | |
|---|---|
| Tank volume | $= 7.2 \times 10^6$ FT$^3$ |
| Initial pressure | = 14.7 psia [Density = 0.1 lb/Ft$^3$] |
| Final pressure | = 5.0 psia [Structural Constraint] |

The weight (W) of the gas in the tank may be calculated as follows:

| | | |
|---|---|---|
| $W$ (initial) | $= 7.2 \times 10^6 \times 0.1$ | $= 7.2 \times 10^5$ LBS |
| (final) | $= .7 \times 10^6 \times 5/14.7 \times 0.1$ | $= 2.4 \times 10^5$ LBS |
| (removed) | $= (7.2 - 2.4)10^5$ | $= 4.8 \times 10^5$ LBS |

The removal rate ($\dot{W}$) after lapse of twenty hours is:

$$W = \frac{4.8 \times 10^5}{20 \text{ HRS}} \times \frac{\text{HR}}{3.6 \times 10^3 \text{ SEC}} = 6.6 \text{ LB/SEC}$$

The required storage volume may be calculated. The evacuated gas is pumped to a higher pressure in a storage container. The stored volume as a function of stored pressure is as follows:

| Storage Pressure (PSIA) | Storage Volume (Ft$^3$) | % Total Tank Volume |
|---|---|---|
| 488 | $1.45 \times 10^5$ | 2.0 |
| 195 | $3.6 \times 10^5$ | 5.0 |
| 78 | $9.0 \times 10^5$ | 12.5 |

Likewise, the horsepower required may be calculated. The pumping can be performed by a reciprocating piston-type or a positive displacement pump that includes several types of rotary compressors. The horsepower requirements are essentially similar, and multiple staging will be required to achieve the desired compression. Radial compressors require less maintenance and service interruptions, but are high speed (RPM) machinery.

For the purpose of this investigation, radial compressors were chosen to demonstrate the feasibility and limitations of this proposed concept. However, if storage pressure in excess of 200 psia are to be considered, the choice would revert to the reciprocating compressor because of its inherent capability of handling low flow rates at high compression pressures. The configuration consists of a series of radial compressors with intercooling and driven by high-gear ratio electric motor. It will be shown that intercooling can reduce the HP requirements by nearly 40%.

Assume each stage of compression provides a pressure ratio (R) of 2.5. Then:

$$R = 2.5$$

$$T_2T/1 = (R)^{1/x} \quad \text{where} \quad T = \text{temp}$$

$$= (2.5)^{.304} \qquad x = (\delta/\delta - i)\eta P$$

$$= 1.32 \qquad \delta = C_p/C_v = 1.27$$

$$\Delta T = .32 \times 560 = 179^\circ \text{ F.} \qquad \eta_p = \text{polytropic efficiency}$$

$$\frac{HP}{W} = \frac{JCp\Delta T}{550} = \frac{778 \times .344 \times 179}{550} = 87 \text{ [per stage]}$$

The benefits of intercooling are demonstrated in the following example:

Non-intercooled

Overall compression ratio = $(2.5)^4$ = 39

Number of stages = 4

Temperature Ratio = $(39)^{.304}$ = 3.05

$$\text{Total HP} = \frac{\dot{W}Jcp\Delta T}{550} = \frac{6.6 \times 778 \times .344 \times 1148}{550} = 3687$$

Intercooled

Temperature to each stage = 100° F.

Pressure ratio per stage = 2.5

Overall compression ratio $(2.5)^4$ = 39

Number of stages = 4

$$HP/\dot{W} = \frac{Jcp\Delta T}{550} = \frac{778 \times .344 \times 170}{550} = 87/\text{stage}$$

Total HP = (4 × 87)6.6 LB/SEC = 2296

$$\frac{\text{HP Intercooled}}{\text{HP Non-Intercooled}} = \frac{2296}{3687} = 0.62$$

| Storage Pressure (psia) | No. of Modules | HP (Intercooling) |
|---|---|---|
| 488 | 5 | 2875 |
| 195 | 4 | 2296 |
| 78 | 3 | 1725 |

This is based on the removal rate of gas mixture controlled to 6.6 LB/SEC at all inlet pressures. If, instead, the rotating machinery controls the flow rate at its rated speed, the HP can for a short time be 3 times this value for a much lower time to remove the gases.

The compressor may also be specified. A preliminary estimate of design features is made for the case of a storage pressure of 195 psia. A bank of 4 modules in series is required. Each module consists of a radial compressor followed by a sea-water heat exchanger. The module configuration is made up of the first two modules shafted together, driven by an electric motor with its speed geared-up to 12,000 rpm. The compressors are arranged back-to-back so the axial thrust due to the pressure loads on the rotors oppose each other. This makes it easy on the bearings. The next two modules are similarly arranged except that the shaft speed is 36,000 rpm. These speed changes ensure acceptable compressor efficiency by keeping the velocities compatible and the areas acceptable.

A compressor design for a first module may proceed as follows:

$P_1$ = 5 psia, pressure ratio $(R)$ = 2.5, $P_2$ = 12.5 psia $$\text{Density } \rho = \frac{5}{14.7} \times 0.1 = 3.4 \times 10^{-2}\ \text{LB/FT}^2$$

Weight Flow Rate $(\dot{W})$ = 6.6 LB/SEC at $P_1$ = 5 psia $$\text{Head}(H) = \frac{\Delta P}{\rho} = \frac{7.5 \times 144}{3.4 \times 10^{-2}} = 31.7 \times 10^3\ \text{FT}$$

$$\text{Rotor Tip Speed } (U_T) = gH\frac{1}{\eta} \cdot \frac{1}{s}\ ^{\frac{1}{2}}$$

$$= \frac{32 \times 31.7 \times 10^3}{0.7 \times 0.95}\ ^{\frac{1}{2}} = 1235\ fps$$

-continued $$\text{Diameter Rotor at Tip } (D_T) = \frac{720 \times U_T}{\pi \times \text{RPM}} \cdot \frac{1}{12}$$

$$= \frac{720 \times 1235}{\pi \times 12 \times 10^3} \cdot \frac{1}{12} = 1.97\ \text{FT}$$

Hub Diameter $(D_h)$ $D_h/D_t = 0.4$, $D_h = .788$ FT, $A_h = 0.484$ FT$^2$

Axial Velocity $(V_z)$ $$V_{zh} = \frac{W}{\rho A_h} = \frac{6.6}{3.4 \times 10^{-2}} \times \frac{1}{.484} = 400\ fps$$

Rotor Speed at Hub $U_h = 0.4 \times 1235 = 494\ fps$

Rotor Thickness at Tip $(t)$ $$t = \frac{W}{\rho V_z} \cdot \frac{1}{\pi D_t}\ 12$$

$$= \frac{6.6}{3.4 \times 10^{-2}} \times \frac{1}{400} \times \frac{12}{\pi \times 1.97} = 0.94\ ins$$

Likewise, a compressor design for a second module may proceed as follows:

$P_1$ = 12.5 psia, $R$ = 2.5, $P_2$ = 31.25 psia, $\Delta P$ = 18.75 psia $$\rho_1 = \frac{12.5}{14.7} \times 0.1 = 8.5 \times 10^{-2}\ \text{LB/FT}^3$$

$$H = \frac{18.75}{8.5 \times 10^{-2}} \times 144 = 31.7 \times 10^3\ \text{FT}$$

$U_T$ = 1235, $D_T$ = 1.97 FT, $A_h$ – .484 FT$^2$ $$D_h/D_t = 0.4\ V_{zh} = \frac{6.6}{8.5 \times 10^{-2}} \times \frac{1}{.484} = 160\ fps$$

$$t = \frac{6.6}{8.5 \times 10^{-2}} \times \frac{1}{160} \times \frac{12}{\pi \times .97} = 0.94\ \text{in.}$$

Likewise for the compressor of module three:

$P_1$ = 31.25 psia, $R$ = 2.5, $P_2$ = 78 psia, $\Delta P$ = 47 psia $$\rho_1 = \frac{31.25}{14.7} \times 0.1 = 2.1 \times 10^{-1}\ \text{LB/FT}^3$$

$H = 31.7 \times 10^3$ft [same on all modules]
$UT = 1235\ fps.$ $$D_T \quad \frac{23.598 \times 10^3}{\text{RPM}}\ \text{[for a tip speed of 1235 } fps\text{]}$$

$$= \frac{23.6 \times 10^3}{36 \times 10^3} = 0.66\ \text{ft}$$

$D_h/D_t = 0.5$, $D_h = .33$ FT, $U_h = 617\ fps.$ $$A_h = 8.5 \times 10^{-2},\ V_{zh} = \frac{6.6}{2.1 \times 10^{-1}} \times \frac{1}{8.5 \times 10^{-2}} = 369\ fps$$

$$t = \frac{6.6}{2.1 \times 10^{-1}} \times \frac{1}{250} \times \frac{12}{\pi \times .66} = .07\ \text{in.}$$

And finally, the compressor of module 4:

$P_1$ = 78.12 psia, $R$ = 2.5, $P_2$ = 195 psia, $\Delta P$ = 117.2 psi $$H = 31.7 \times 10^3,\ P_1 = \frac{78.125}{14.7} \times .1 = 5.3 \times 10^{-1}\text{psi}$$

$$U_T - 1235,\ D_T = \frac{23.59 \times 10^3}{\text{RPM}} = \frac{23.59 \times 10^3}{36 \times 10^3} = 0.65\ \text{FT}$$

-continued $D_h/D_t = 0.5,\ D_h = .33\ \text{FT},\ U_h = 617\ fps$ $$A_h = 8.5 \times 10^{-2},\ V_{zh} = \frac{6.6}{5.3 \times 10^{-1}} \times 8.5 \times 10^{-2} = 140\ fps$$

$$t = \frac{6.6}{5.3 \times 10^{-1}} \times \frac{12}{100 \times .66 \times \pi} = .07\ \text{in.}$$

For a preliminary approach, all design values are within acceptable compressor design margins.

The required heat exchanger may be calculated. A counter flow heat exchanger is used after each stage of compression cooling the gaseous mixture from the compression exit temperature of 280° F./ down to 100° F. with the salt water coolant at 70° F.

$$\text{Effective Ratio}\ \frac{280 - 100}{280 - 70} = 0.85$$

This can be obtained with these parameters:

$$\frac{\mu A}{W_h C_h} \sim 3.5$$

$$\frac{\dot{W}_h C_h}{\dot{W}_c C_c} \sim 0.8$$

where
$\dot{W}_h \sim$ gas flow rate
$\dot{W}_c \sim$ coolant flow rate
$C_h/C_c \sim$ specific heat of gas/water
From (1)

$$W_c = \dot{W}_h \times C_h/C_c \times \frac{1}{0.8}$$

$$= 6.6 \times .344 \times \frac{1}{0.8} = 2.8\ \text{LB/SEC}$$

$$\text{Pumping Head} = \frac{\Delta P}{\rho} = \frac{10 \times 144}{64} = 22.5\ \text{FT}$$

$$\text{HP}/_{module} = \frac{W\frac{\Delta P}{\rho}}{550 \times \eta} = \frac{2.8 \times 22.5}{550 \times 0.5} = 0.2\ \text{HP}$$

The slave pump power requirements are minuscule for pumping sea-water through the heat exchangers.

The requirements for gas removal from the ullage spaces may be calculated as follows:

| | |
|---|---|
| Ullage Volume ($V_o$) | $= 144 \times 10^3\ \text{FT}^3$ |
| Initial Ullage Pressure | = 14.7 psia |
| Density ($\rho$) | $= 0.1\ \text{LB/FT}^3$ |
| Final Ullage Pressure | = 12.7 psia |
| Density $\frac{12.7}{14.7} \times .1$ | $= 8.6 \times 10^{-2}\ \text{LB/FT}^3$ |
| Initial Ullage Gas Weight ($\rho V$) | $= 14.4 \times 10^3$ LBS |
| Final | $= 12.4 \times 10^3$ LBS |
| Ullage Gas Removed | $= 2 \times 10^3$ LBS |

Consider storage pressure at 2 levels (79 and 197 psia) to determine HP and storage volume requirements.

| | | |
|---|---|---|
| Weight of Gas Removed (LBS) | $2 \times 10^3$ | |
| Storage Pressure (psia) | 79 | 197 |
| Compression Ratio | 6.25 | 15.6 |
| Temperature Ratio | 1.75 | 2.3 |
| Temperature Rise (°F.) | 420 | 728 |
| $\text{HP}/\dot{W}$ ($^{HP}/_{LB/SEC}$) | 204 | 354 |
| Storage Density ($\text{LB/FT}^3$) | 0.54 | 1.34 |
| Storage Volume ($\text{FT}^3$) | 3700 | 1492 |
| Diameter Sphere (FT) | 19 | 14 |

The horsepower (HP) requirement is basically a function of the compression ratio and the flow rate. For the 2 levels of compression ratio considered the HP is essentially the time allocated for the removal of the ullage gas at whatever level of compression is being evaluated.

| | | | | |
|---|---|---|---|---|
| Compression Ratio | 6.25 | | 15.6 | |
| $\text{HP}/\dot{W}$ ($^{HP}/_{LB/SEC}$) | 204 | | 354 | |
| Time Allocated for Gas Removal (HRS) | 1 | 10 | 1 | 10 |
| $\dot{W}$ ($^{LB}/_{SEC}$) | .55 | .055 | .55 | .055 |
| CFM | 354 | 35 | 354 | 35 |
| HP | 112 | 11 | 195 | 20 |

The low range of flow rates [35–350 cfm] and compression ratios [6–16] and power requirements [10–200] makes a reciprocating compressor with multiple stage operations an ideal candidate that can probably be acquired off-the-shelf.

In accordance with these and other possible parameterizations and constructions of the system in accordance with the present invention, the invention should be interpreted broadly, and in accordance with the following claims, only, and not solely in accordance with that embodiment within which the invention has been taught.

I claim:

1. A vapor control system for a tank of a ship comprising:

a gas compression pump means, flow-connected to the ullage space of the ship's tank, operating during a first period of time to compress gases and vapors collected from the ullage space to a first pressure;

a storage tank means for storing the compressed gases in isolation from the atmosphere at the first pressure;

a gas evacuation pump means, flow-connected to the ullage space of the ship's tank, operative for evacuating remaining, uncollected, gases and vapors from the ullage space at a second pressure less than the first pressure;

an ullage space of another, second, tank for temporarily storing at the second pressure the gases and vapors evacuated from the tank's ullage space by the evacuation pump means.

2. The vapor control system according to claim 5 further comprising:

a first gas flow conduit flow-connecting the gas evacuation pump means to the ullage space of the second tank; and a second gas flow conduit flow-connecting the ullage space of the second tank to the compression pump means;

wherein the gas evacuation pump means is flow-connected to a flow of gas and vapor from the ullage space to the compression pump means, and is flow-connected in series with the compression pump means.

3. The vapor control system according to claim 2 wherein the gas evacuation pump means that is series-flow-connected with the compression pump means develops a third pressure less than atmospheric pressure in the ullage space of the tank, which third pressure is in magnitude much less than the first pressure.

4. The vapor control system according to claim 2 wherein the gas evacuation pump means that is series-flow-connected with the compression pump means is also operative to evacuate gases and vapors from the ullage space of the tank during the compressing of the compression pump means during the first time, serving to boost the pressure of the evacuated gases and vapors en route to the compressor pump means by the second pressure that is less than the first pressure.

5. The vapor control system according to claim 1 wherein the gas evacuation pump means is in parallel with the compression pump means.

6. The vapor control system according to claim 1 wherein the compression pump means comprises:

a plurality of gas pumps connected in series for successively compressing the gases and vapors from the ullage space at higher and higher pressures until a last such gas pump connects to the storage tank means.

7. The vapor control system according to claim 1 wherein the compression pump means comprises:

a radial flow gas compressor.

8. The vapor control system according to claim 1 wherein the compression pump mean comprises:

a reciprocating-piston gas compressor.

9. The vapor control system according to claim 1 which further comprises:

a heat exchanger means between the compression pump means and the storage tank means for removing some of a heat of compression from the compressed gases.

10. The vapor control system according to claim 9 wherein the heat exchanger means comprises:

a counterflow heat exchanger exchanging the heat of the compressed gases with seawater.

11. A vapor control system for a tank of a ship comprising:

a gas compression pump means, flow-connected to the ullage space of the ship's tank, operating during a first time to compress gases and vapors collected from the ullage space to a first pressure;

a storage tank means for storing the compressed gases in isolation from the atmosphere at the first pressure;

a gas evacuation pump means, flow-connected to the ullage space of the ship's tank, controllably operative during a second time, after the first time, to evacuate under a second pressure, less than the first pressure, remaining, uncollected, gases and vapors from the ullage space; and an underpressure control for controlling the controllable gas evacuation pump to maintain a third pressure less than atmospheric pressure, and less than the first and the second pressures, within the ullage space of the tank so that internal and external pressure forces acting on the liquid contents of the tank at a site of any incipient rupture to such tank will be in balance regardless that such forces should vary upon the occurrence, and upon the location, of the rupture.

12. A system to control any emission of vapors from a tank containing a vaporizable liquid simultaneously that any spillage of liquid due to a rupture of the tank is reduced, the system comprising:

means for maintaining a pressure less than atmospheric pressure within an ullage space of the tank containing the vaporizable liquid so that internal and external pressure forces acting on the liquid contents of the tank at a site of any rupture to such tank will be in balance regardless that such forces should vary upon the occurrence, and upon the location, of the rupture, the pressure-maintaining means comprising:

an evacuation gas pumping means connected to the ullage space of the tank for removing gases and vapors from the ullage space so as to maintain the pressure less than atmospheric therein; and means for preventing that vapors of the vaporizable liquid that are within the gases and vapors removed form the ullage space of the tank by the evacuation gas pumping means should be vented to the atmosphere, the vapor-venting preventing means comprising:

a compression gas pumping means for compressing the gases and the vapors that are removed from the ullage space by the evacuation gas pumping means; and a storage tank means for storing the compressed gases and vapors in isolation from the atmosphere.

13. The vapor-emission-controlling liquid-spill-preventing system according to claim 12 further comprising:

means for creating a non-explosive mixture of gases and vapors in the ullage space of the tank.

14. The system according to claim 13 wherein the means for creating comprising:

inert gas source means, flow-connected to the ullage space of the tank, for putting an inert gas into the ullage space so as to render the mixture of gases and vapors therein to be non-explosive;

wherein one of the gases that the evacuation gas pumping means is removing from the ullage space is the inert gas that is put into the ullage space by the inert gas source means; and wherein one of the gases that the compression gas pumping means is compressing is the inert gas.

15. The vapor-emission-controlling liquid-spill-preventing system according to claim 12 adopted for use on a tank of a ship wherein the means for maintaining operates to maintain the non-explosive mixture of gases at the pressure less than the atmospheric pressure commencing at a time prior to a voyage of the ship;

wherein the compression gas pumping means operates to compress the gases and vapors commencing at the time prior to the voyage of the ship; and wherein the means for creating operates to create the non-explosive mixture of gases commencing at the time prior to the voyage of the ship.

16. The vapor-emission-controlling liquid-spill-preventing system according to claim 12 adopted for use on a tank of a ship wherein the means for maintaining is maintaining the pressure that is less than the atmospheric pressure substantially continuously during a voyage of the ship.

17. The vapor-emission-controlling liquid-spill-preventing system according to claim 12 adopted for use on a tank of a ship containing oil wherein the means for creating is filling the ullage space above the liquid level of the ship's tank's oil with inert gas so as to produce a mixture of air, inert gas and evaporated hydrocarbon vapors.

18. The vapor-emission-controlling liquid-spill-preventing system according to claim 12 adopted for use on a tank of a ship wherein the means for maintaining further comprises:

means for monitoring the pressure less than atmospheric pressure within the ullage space of the ship's tank; and a vacuum sub-system comprising:

pump means for controllably creating and maintaining the pressure less than atmospheric pressure in the ruptured tank; and a computer, responsive to the means for monitoring, for controlling the pump means so as to produce and maintain the pressure that is less than atmospheric pressure.

19. A system to (i) control volatile organic hydrocarbon vapor emissions from a ship's tank containing oil while (ii) reducing any spillage of oil from a rupture to the ship's tank, the system comprising:

inerting means for maintaining a gaseous mixture enhanced with an inert gas in an ullage space above the oil within the ship's tank containing oil, the mixture being sufficiently enhanced with the inert gas so as to reduce the flammability of volatile organic hydrocarbon vapors and air within this ullage space;

vacuum means controllable for removing air, organic hydrocarbon vapors, and the gaseous mixture enhanced in inert gas from the ullage space so as to maintain a gaseous pressure within the ullage space that is than atmospheric pressure nonetheless that mixture of gases therein is enhanced in the inert gas;

control means for controlling the vacuum means so as to maintain a balance of forces acting upon the oil within the tank upon occasion of the tank's rupture so as to impede any spillage of oil from the tank through the rupture; and means for preventing that organic hydrocarbon vapor that are within the removed gases should be vented to the atmosphere.

20. A method of simultaneously managing the (i) makeup, (ii) pressure, and (iii) emission of a mixture of gases and vapors that are within an ullage space of a tank containing a vaporizable liquid, the method comprising:

establishing and maintaining the relative proportions of a plurality of individual gases, both flammable and nonflammable, that are within the ullage space of the tank containing a vaporizable liquid so as to be, as an aggregate mixture of gases and vapors, non-explosive by a process of:

pumping an inert gas into the ullage space; meanwhile simultaneously maintaining substantially continuously during a voyage of the ship a gas pressure of the mixture of gases and inert gas and vapors within the ullage space to be of a magnitude less than atmospheric pressure by a process of:

pumping the mixture of gases and inert gas and vapors from the ullage space; meanwhile simultaneously preventing that at least the vapors Of the pumped mixture of gases and inert gas and vapors should be emitted to the atmosphere by a process of compressing the gases and the inert gas and the vapors that are removed from the ullage space by pumping; and storing the compressed gases and inert gas and vapors in isolation from the atmosphere.

21. The method according to claim 20 adapted for use in the tank of a ship containing oil wherein the maintaining comprises:

constantly and dynamically maintaining the ullage space gas pressure $P_v$, which ullage space gas pressure is less than atmospheric pressure, to be of a magnitude which, when added to an instantaneous hydrostatic pressure of the oil at a height $h_i$ above any rupture to the tank, will equal an external pressure $P_E$ that is occurring at the highest point of said rupture to the tank;

wherein said external pressure $P_E$ is itself equal to the atmospheric pressure $P_A$ plus a hydrostatic water pressure occurring at a height $h_e$ of the ship's waterline above said highest point of the rupture;

wherein because an internal pressure within the tank, which internal pressure equals the controlled ullage pressure $P_v$ plus the hydrostatic oil pressure, is dynamically maintained equal to said external pressure $P_E$, which external pressure equals the uncontrolled atmospheric pressure $P_A$ plus the hydrostatic water pressure, any oil out-flow, or spillage, from the tank is substantially prevented from points above said highest point of the rupture.

22. The method according to claim 21 further comprising upon the occurrence of any rupture to the ship's tank which rupture is below the ship's waterline:

placing a non-structural barrier at the location of the rupture to the tank that is below the ship's waterline, and in position between the oil that is within the tank and the surrounding water, so as to aid, by avoidance of stratified flow, said oil out-flow, or spillage, from points below said highest point of the rupture.

23. A system for simultaneously managing the (i) composition and the (ii) pressure and the (iii) emission of fluid vapors from an ullage space of a ship's tank containing a vaporizable fluid where any spillage of such fluid from the tank upon any rupture to the tank is desired, insofar as is possible, to be avoided, the system comprising:

partial vacuum means for evacuating gases and vapors that are within the ullage space of the tank so as to create and maintain within the ullage space a gas pressure that is less than atmospheric pressure, this creating and maintaining being so that pressure forces acting on the fluid contents of the tank are maintained in balance regardless that such forces should vary upon the occasion of any rupture of the tank;

inert gas means for introducing an inert gas into the ullage space of the tank sufficient in amount so as to render a resulting mixture of a plurality of gases and vapors, including the inert gas itself, that are within the ullage space to be non-explosive, this introducing being simultaneously with, and regardless that, the partial vacuum means is creating and maintaining the pressure less than atmospheric pressure; and means for preventing that vapors of the vaporizable liquid that are within the removed gases should be vented to the atmosphere.

24. The system according to claim 23 wherein the means for preventing comprises:

a compression gas pumping means for compressing the gases, including vapors, that are removed from the ullage space by the evacuation gas pumping means; and a storage tank means for storing the compressed gases, including vapors, in isolation from the atmosphere.

* * * * *